US010316374B2

(12) United States Patent
Torti

(10) Patent No.: US 10,316,374 B2
(45) Date of Patent: Jun. 11, 2019

(54) CUTTING DEVICE FOR MACHINES FOR CUTTING HIDES AND THE LIKE

(71) Applicant: COMELZ S.P.A., Vigevano (IT)

(72) Inventor: Franco Torti, Vigevano (IT)

(73) Assignee: COMELZ S.P.A., Vigevano (IT)

( * ) Notice: Subject to any disclaimer, the term of this patent is extended or adjusted under 35 U.S.C. 154(b) by 80 days.

(21) Appl. No.: 15/303,289

(22) PCT Filed: Nov. 18, 2014

(86) PCT No.: PCT/EP2014/074871
§ 371 (c)(1),
(2) Date: Oct. 11, 2016

(87) PCT Pub. No.: WO2015/154830
PCT Pub. Date: Oct. 15, 2015

(65) Prior Publication Data

US 2017/0037487 A1 Feb. 9, 2017

(30) Foreign Application Priority Data

Apr. 11, 2014 (IT) ..... MI2014A0685

(51) Int. Cl.
*C14B 5/00* (2006.01)
*B26D 5/12* (2006.01)
*B26F 1/38* (2006.01)

(52) U.S. Cl.
CPC ..... *C14B 5/00* (2013.01); *B26D 5/12* (2013.01); *B26F 1/382* (2013.01)

(58) Field of Classification Search
CPC ..... B26F 1/382; B26D 5/12; C14B 5/06
USPC ..... 69/2; 83/435.17, 435.22
See application file for complete search history.

(56) References Cited

U.S. PATENT DOCUMENTS 3,028,840 A * 4/1962 Leaveil ..... B25D 9/08 173/1
4,109,734 A * 8/1978 Montabert ..... B25D 9/12 173/114
4,293,045 A * 10/1981 Zeidman ..... B26D 5/12 173/121

(Continued)

FOREIGN PATENT DOCUMENTS

AU 5927965 A 11/1967
CN 201778031 U 3/2011
WO WO 2004095965 A1 11/2004

OTHER PUBLICATIONS

International Search Report and Written Opinion dated Dec. 11, 2014 issued in PCT/EP2014/074871.

*Primary Examiner* — Shaun R Hurley
*Assistant Examiner* — Bao-Thieu L Nguyen
(74) *Attorney, Agent, or Firm* — Scully, Scott, Murphy & Presser, P.C.

(57) ABSTRACT

A cutting device for machines for cutting hides and the like, including an oscillating piston provided at its end with a cutting blade, the oscillating piston being actuated pneumatically by way of an inlet and an outlet, an oscillation chamber being defined by the lower and upper stroke limits of the oscillating piston, the device including a supply duct that leads to the oscillation chamber, the supply duct being regulated by a solenoid valve in order to raise the oscillating piston and consequently raise the cutting blade.

5 Claims, 2 Drawing Sheets

(56) References Cited

U.S. PATENT DOCUMENTS 4,380,901 A * 4/1983 Rautimo ..... B25D 9/12 60/418
4,460,051 A * 7/1984 Widmer ..... B25D 17/24 173/162.1
4,466,493 A * 8/1984 Wohlwend ..... B25D 9/265 173/19
4,552,227 A * 11/1985 Wohlwend ..... B25D 9/265 173/15
4,784,228 A * 11/1988 Ito ..... B25D 9/145 173/208
4,817,737 A * 4/1989 Hamada ..... B25D 9/12 173/115
4,840,236 A * 6/1989 Goldman ..... B23D 15/14 173/13
4,951,757 A * 8/1990 Hamada ..... B25D 9/12 173/115
5,134,989 A * 8/1992 Akahane ..... B25D 9/145 125/23.01
5,279,120 A * 1/1994 Sasaki ..... B25D 9/145 173/135
5,392,865 A * 2/1995 Piras ..... B25D 9/145 173/137
5,640,877 A * 6/1997 Danly, Sr. ..... B21D 28/24 100/269.06
5,765,462 A * 6/1998 Mannio ..... B26D 1/065 83/639.1
6,073,706 A * 6/2000 Niemi ..... B25D 9/18 173/138
6,119,795 A * 9/2000 Lee ..... B25D 9/00 173/114
7,261,223 B2 * 8/2007 Tilley ..... B23D 59/02 184/104.1
7,353,845 B2 * 4/2008 Underwood ..... E21B 4/14 137/207
8,141,655 B2 * 3/2012 Pillers, II ..... B23B 31/113 173/171
8,156,856 B2 * 4/2012 Abe ..... F16J 15/164 92/162 R
8,291,938 B2 * 10/2012 Kennedy ..... F15B 1/24 137/14
8,485,004 B2 * 7/2013 Kobayashi ..... C14B 5/00 69/2
8,733,468 B2 * 5/2014 Teipel ..... B25D 9/12 173/135
9,592,598 B2 * 3/2017 Moore ..... B25D 9/145
9,822,802 B2 * 11/2017 Moore ..... F15B 1/04
2001/0043007 A1 * 11/2001 Jang ..... B25D 9/145 299/69
2006/0283612 A1 * 12/2006 Pillers, II ..... B23B 31/113 173/128
2007/0175670 A1 * 8/2007 Henriksson ..... B25D 9/12 175/417
2012/0138328 A1 * 6/2012 Teipel ..... B25D 9/12 173/207
2012/0152582 A1 * 6/2012 Pillers, II ..... B23B 31/113 173/206
2014/0262406 A1 * 9/2014 Moore ..... B25D 9/145 173/208

* cited by examiner

CUTTING DEVICE FOR MACHINES FOR CUTTING HIDES AND THE LIKE

BACKGROUND OF THE DISCLOSURE

The present invention relates to a cutting device for machines for cutting hides and the like. More specifically, the invention relates to a cutting device that is adapted to be used in machines for cutting hides, leather, materials in sheets or rolls, etc.

As is known, in the sector of machinery for digitally controlled cutting of materials that are extended flat, sheet-like, natural or synthetic, such as hide, leather, materials in sheets or rolls, etc., the cutting tool generally used is mounted in a tool head and is constituted by a blade that is adapted to oscillate vertically at high frequency and is moved in a substantially horizontal plane by way of digital control, on the material along the path of shapes to be cut which are defined or projected on the material.

So as to be deployed correctly on the material to be cut, in order to pass from the cutting of one shape to the next and furthermore in order to execute cutting paths with sharp corner edges, which require the extraction of the blade from the material, it is necessary to bring the oscillating blade vertically out of the material to be cut, in order to then move it conveniently by way of rapid movements, imposed by the digital controller, through the movement axes.

To such end, the cutting device or cutting head must be provided with a system of vertical movement.

The aim is to be able to raise the cutting blade as quickly as possible, especially when executing cutting paths with sharp corner edges (such as for example jagged sections of the outline of the piece), and this is because it enables a reduction in the times for executing the cutting operation.

Currently, the conventional cutting devices have a vertical rise speed of the blade, by way of movement of an oscillating spindle or of an entire tool head, which is limited by the inertia of the moved assembly, by the characteristics of guide systems along which the assembly is moved, and by the dynamic characteristics of the actuators that are adapted to achieve the above mentioned movement.

Techniques are known of returning pneumatic pistons to the stroke limit position, which are based on a spring inserted in the cylinder which pushes the piston into abutment in the absence of a pneumatic supply to the latter.

One solution for the above mentioned cutting devices which is based on such technique thus involves the insertion of a spring propelling the oscillating piston toward the upper stroke limit position, once the pneumatic supply for oscillation of the piston that supports the cutting blade has been deactivated. Such configuration has however a number of drawbacks including the fact that such spring would produce a constant force on the oscillating piston, thus limiting its power during oscillation and penalizing the dynamic characteristics in terms of the ratio of stroke to oscillation frequency.

Furthermore, such spring would require a high capability to withstand extremely high operating frequencies, which is difficult and costly to obtain.

BRIEF SUMMARY OF THE DISCLOSURE

The aim of the present invention is to provide a cutting device for machines for cutting hides and the like, in which the penetration and extraction of the blade, vertically, occurs in reduced times with respect to the known art.

Within this aim, an object of the present invention is to provide cutting devices for machines for cutting hides and the like, in which the cutting blade can be stopped in the raised-blade position in extremely fast times and without this involving limitations on the oscillation frequency of the piston that actuates the cutting blade during operation.

Another object of the present invention is to provide a cutting device for machines for cutting hides and the like, in which the rapid-raise characteristic of the cutting blade does not negatively influence the normal oscillation of the cutting blade in the operating condition.

Another object of the present invention is to provide a cutting device, for machines for cutting hides and the like, which is highly reliable, easily and practically implemented and low cost.

This aim and these and other objects which will become better apparent hereinafter are achieved by a cutting device for machines for cutting hides and the like, comprising an oscillating piston provided at its end with a cutting blade, said oscillating piston being actuated pneumatically by way of an inlet and an outlet, an oscillation chamber being defined by the lower and upper stroke limits of said oscillating piston, characterized in that it comprises a supply duct that leads to said oscillation chamber, said supply duct being regulated by a solenoid valve in order to raise said oscillating piston and consequently raise said cutting blade.

BRIEF DESCRIPTION OF THE FIGURES

Further characteristics and advantages of the invention will become better apparent from the description of a preferred, but not exclusive, embodiment of the device according to the present invention, which is illustrated by way of non-limiting example in the accompanying drawings wherein.

DETAILED DESCRIPTION OF THE DISCLOSURE

Figure 1:
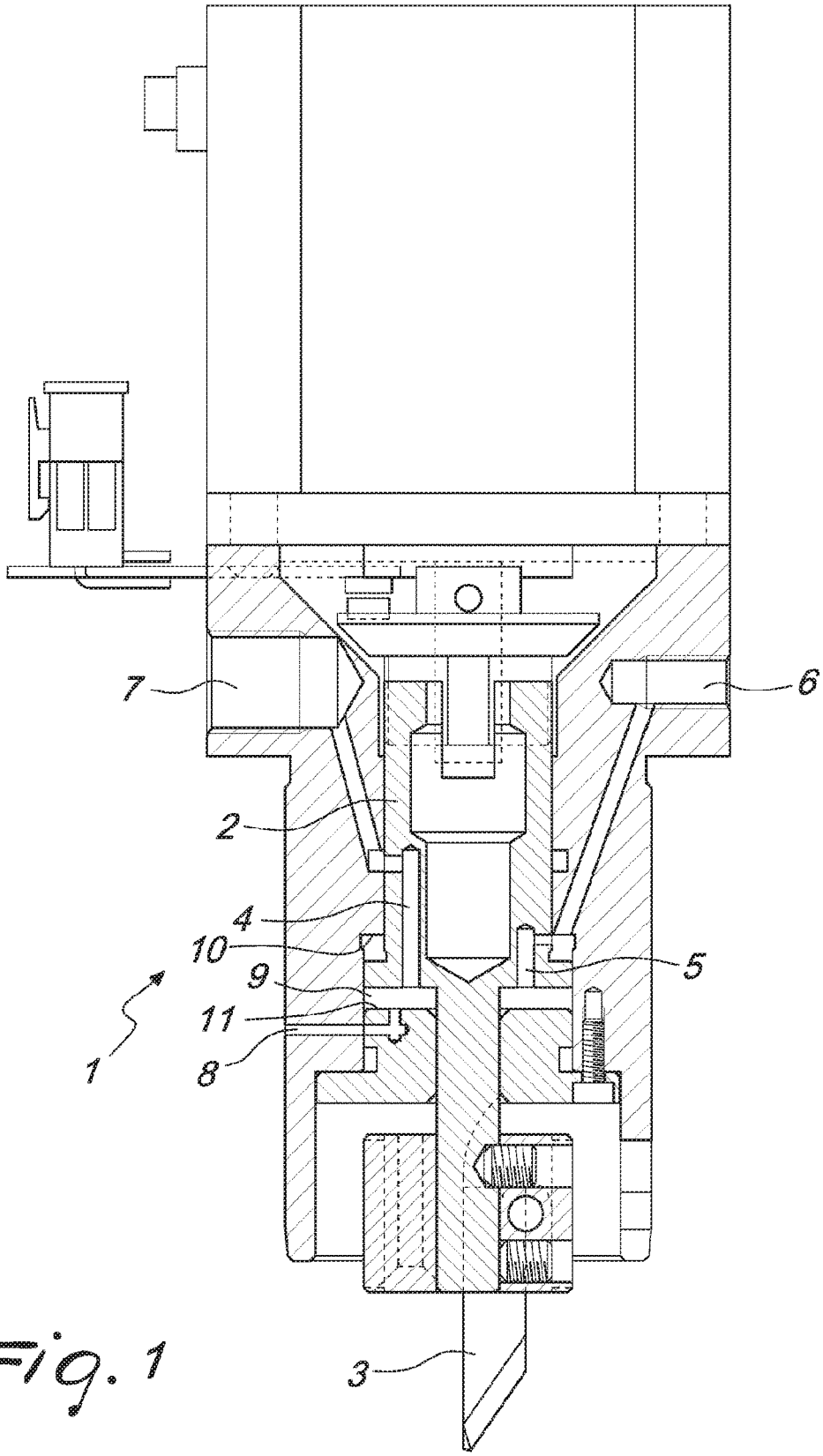
FIG. 1 is a cross-sectional view of the cutting device according to the present invention, in the operating condition.

With reference to the figures, the cutting device according to the invention, generally designated by the reference numeral 1, comprises a piston 2 that can move in an oscillating manner and which supports a cutting blade 3 at one end.

The piston 2 is moved in oscillation by way of pneumatic actuation.

Conveniently, the piston 2 is provided with channels, 4 and 5, which, in its oscillation, are connected with an inlet 6 and an outlet 7.

In particular, the channel 4 is connected with the outlet 7 while the channel 5 is connected with the inlet 6.

The pneumatic actuation through the inlet and the outlet moves the piston 2 in an oscillating manner and thus, in conjunction, the blade 3 that is connected thereto.

In the device according to the invention, a duct 8 is provided that is connected to the lower region of an oscillation chamber 9 that has two walls, an upper wall 10 and a lower wall 11, which define the maximum possible stroke of the oscillating piston 2. Such oscillation chamber thus determines the lower and upper stroke limits of the oscillating piston.

Obviously, the stroke of the oscillating piston 2 can be less than the maximum possible stroke permitted by the chamber 9, just as the cutting of the material can occur with a stroke of the oscillating piston 2 of a lower value than the thickness of the material to be cut.

When the oscillation pneumatic supply is cut, i.e. by cutting the supply to the inlet 6, the piston 2 stops oscillating and, at this point, by way of the duct 8, it is possible to direct pneumatic pressure so as to propel the piston 2 toward the upper stroke limit position.

Figure 2:
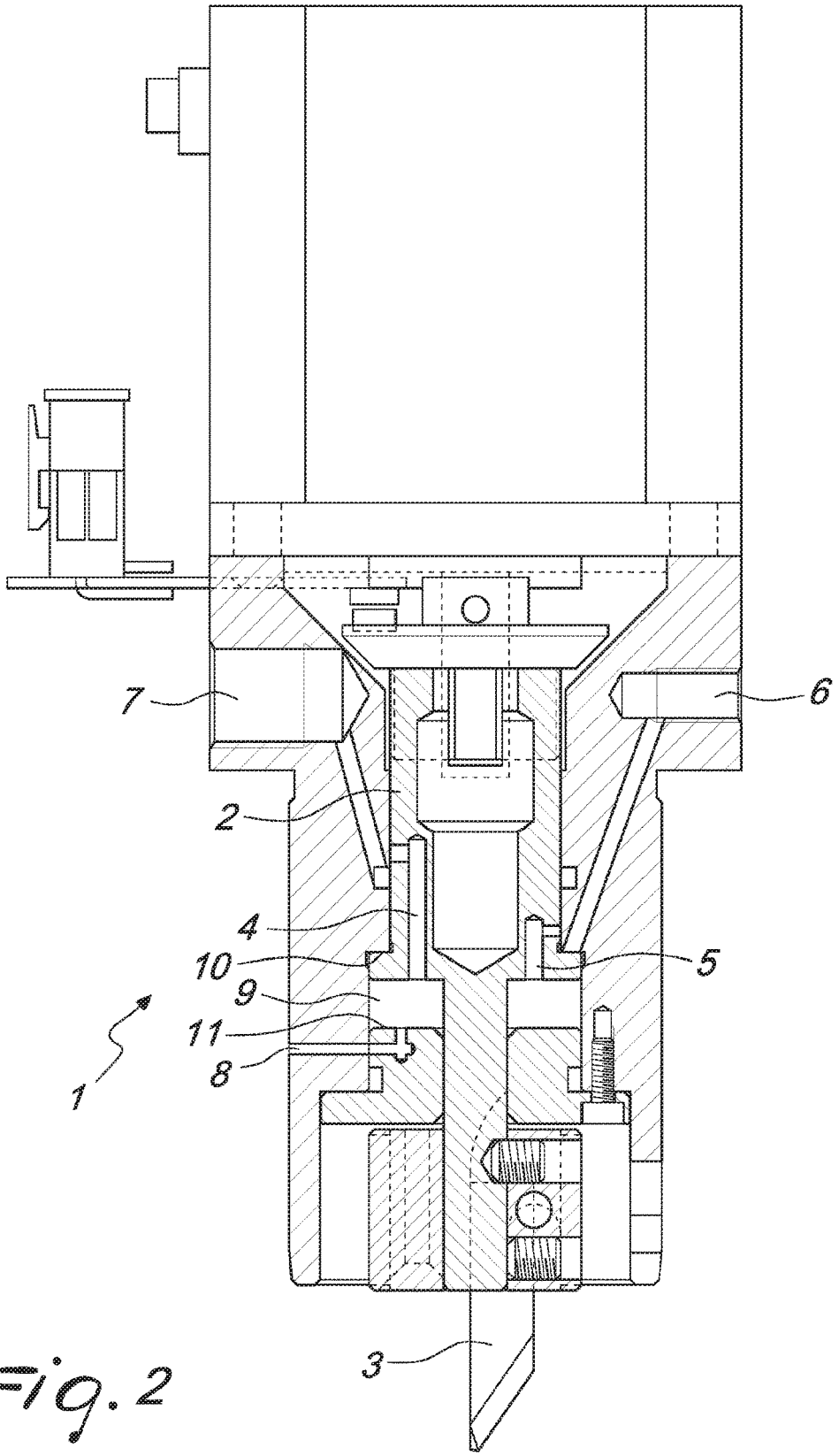
FIG. 2 is a cross-sectional view of the cutting device according to the present invention, in the raised-blade condition.

Such condition is shown in FIG. 2, in which the lower region of the oscillation chamber 9 reaches the maximum size, with the piston thus in the upper stroke limit position.

In such condition, the blade 3 is raised from the material that is to be cut and an essential condition is that, in the raised-blade condition, the duct 8 for actuating the raising of the blade is not connected with the outlet, so as to ensure a good thrust force and without losses or consumption of pressure.

The pneumatic actuation of the raised-blade command through the duct 8 is regulated by an adapted solenoid valve.

It should be noted that the duct 8 through which pneumatic pressure is introduced does not interfere with the equilibrium of the oscillating piston during the oscillation of the piston, intervening solely upon interruption of the oscillation pneumatic supply by pushing on the oscillating piston.

In practice it has been found that the device according to the present invention fully achieves the set aim and objects, in that it makes it possible to raise the cutting blade connected to the oscillating piston very rapidly and effectively, without such raising device interfering in any way with the oscillation of the piston under normal operating conditions, during cutting of the hide or the like by the cutting blade.

The device, thus conceived, is susceptible of numerous modifications and variations, all of which are within the scope of the appended claims. Moreover, all the details may be substituted by other, technically equivalent elements.

In practice the materials employed, and the contingent dimensions and shapes, may be any according to requirements and to the state of the art.

The disclosures in Italian Patent Application No. MI2014A000685 from which this application claims priority are incorporated herein by reference.

The invention claimed is:

1. A cutting device for machines, comprising:

an oscillating piston provided at an end thereof with a cutting blade, said oscillating piston being actuated pneumatically by way of an inlet and an outlet, an oscillation chamber being defined by the lower and upper stroke limits of said oscillating piston, said inlet being in communication with said oscillation chamber, said outlet being configured to be in communication with the oscillation chamber during a portion of a stroke of said oscillating piston, further comprising a supply duct that leads to said oscillation chamber, said supply duct being regulated by a solenoid valve in order to raise said oscillating piston and consequently raise said cutting blade, said supply duct being in communication with said outlet when said outlet is in communication with said oscillation chamber.

2. The device according to claim 1, wherein said supply duct that leads into said oscillation chamber in the raised condition of said cutting blade is disconnected from the outlet of said oscillating piston.

3. The device according to claim 1, wherein said supply duct that leads to said oscillation chamber is adapted to allow a pneumatic supply that is adapted to act on said oscillating piston in order to raise said oscillating piston.

4. The device according to claim 3, wherein said solenoid valve is adapted to be actuated following an interruption of the pneumatic supply when said cutting device is in the raised condition.

5. A machine for cutting, further comprising a cutting device according to claim 1.

* * * * *